United States Patent [19]

v.Eckardstein et al.

[11] 4,373,225

[45] Feb. 15, 1983

[54] PIPING VALVE WITH A HOUSING FOR THE TRANSFER OF A WIPER INSERTABLE IN CONDUITS THAT SUPPLY PRESSURIZED VISCOUS MATERIAL, PREFERABLY CONCRETE

[75] Inventors: Karl-Ernst v.Eckardstein, Kamen; Werner Fiala; Friedrich Schwing, both of Herne, all of Fed. Rep. of Germany

[73] Assignee: Friedrich Wilh. Schwing, GmbH, Herne, Fed. Rep. of Germany

[21] Appl. No.: 165,140

[22] Filed: Jul. 1, 1980

[30] Foreign Application Priority Data

Jul. 6, 1979 [DE] Fed. Rep. of Germany ..... 2927324
Oct. 31, 1979 [DE] Fed. Rep. of Germany ..... 2943967

[51] Int. Cl.[3] ..... B08B 9/04
[52] U.S. Cl. ..... 15/104.06 A
[58] Field of Search ..... 15/104.06 R, 104.06 A, 15/104.06 B, 3.5, 3.51; 166/70, 153; 137/268

[56] References Cited

U.S. PATENT DOCUMENTS

| | | | |
|---|---|---|---|
| 2,087,679 | 7/1937 | Bail et al. | |
| 2,713,909 | 7/1955 | Baker | 15/104.06 A X |
| 3,000,028 | 9/1961 | Buie et al. | |
| 3,063,079 | 11/1962 | Bergman et al. | 15/104.06 A |
| 3,146,477 | 9/1964 | Bergman et al. | 15/104.06 A |

FOREIGN PATENT DOCUMENTS

| | | |
|---|---|---|
| 536529 | 10/1931 | Fed. Rep. of Germany . |
| 2624780 | 12/1976 | Fed. Rep. of Germany . |

*Primary Examiner*—Edward L. Roberts
*Attorney, Agent, or Firm*—Andrus, Sceales, Starke & Sawall

[57] ABSTRACT

A piping valve for conduits conveying pressurized viscous material, such as concrete, provides a means for introducing a wiper into the conduit for cleaning purposes. The piping valve has a reciprocally displaceable part with a transmission pipe and a pipe chamber containing the wiper. The reciprocally displaceable part may be moved between a first position in which it is aligned with the conduit and a second position in which it receives the wiper for passage through the conduit.

11 Claims, 13 Drawing Figures

Figure 1:
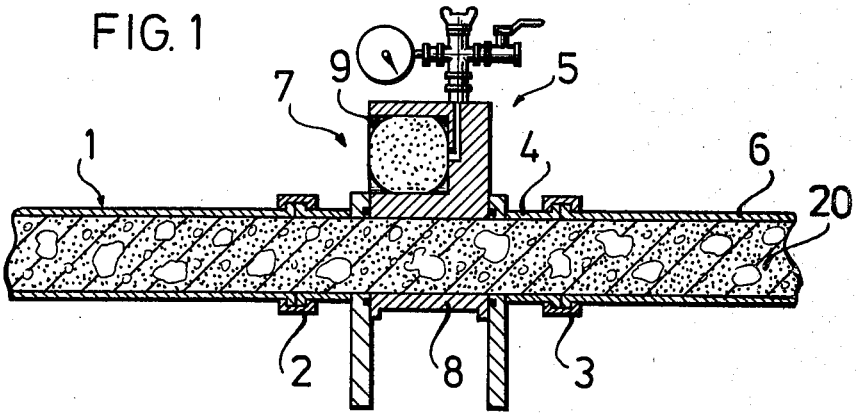

9
7
19
4
1
6
2
8
3

15
P
21
22
4
1
19
6
2
9'
3
8

9
7
9'
4
1
19
6
24
2
8
3

PIPING VALVE WITH A HOUSING FOR THE TRANSFER OF A WIPER INSERTABLE IN CONDUITS THAT SUPPLY PRESSURIZED VISCOUS MATERIAL, PREFERABLY CONCRETE

The invention relates to a piping valve with a housing for the transfer of a wiper insertable in conduits that supply pressurized viscous material, preferably concrete. The wiper is preferably a ball, that is forced through the conduit with a pressure means.

The invention is explained in the following with the aid of a preferred field of use, although it is usable beyond the cleaning of concrete conveying conduits, for example with other viscous material conveying conduits that convey settling mud of pulpy to muddy consistency, which sets in the conduit for extended stationary periods of the conveying movement. Concrete is a particularly troublesome case, because set concrete in metal piping causes blockages that as a practical matter are not displaceable. Therefore, concrete conveying conductors at the end of the concrete conveying must not only be emptied, but also cleanly wiped out.

It is known, to reverse convey in a conduit typically fastened on a concrete distribution mast through reverse suction of the concrete contained in the conduit into the reservoir of the concrete pump coacting with the mast arranged at the base of the conduit, whereby in the free end of the conduit a wiper in the form of a ball formed out of an elastic material is inserted.

The process however requires, that the reservoir occupy an exceedingly large volume in order to hold the reverse suctioned concrete. On the one hand on account of the larger conduit diameters with modern concrete conveying equipment, on the other hand on account of the restricted dimensions of, in particular, concrete pumps mounted on truck chassis the reservoir dimensions are frequently not sufficient. That leads to dirtying of the parts lying outside the reservoir and its surroundings by the reverse suction of the remaining concrete. Beyond that, the reverse suctioned concrete must be emptied out of the reservoir. As that occurs at the end of the concrete conveying there is no possibility of utilization of this concrete. As a result concrete losses occur that are considerable on account of the large conduit diameter. Besides, the construction site is soiled with the remaining concrete because the excess remaining concrete typically is ejected there.

One can force the residual concrete as a practical matter, only with difficulty in the reverse direction through the conduit. That is based, among other grounds, on the pressure, under which the concrete filling of the conduit stands with an erected mast. Also, the dimensions of the building site do not allow displacement of the mast to the position that would be necessary for the pressure relief of the conveying conduit. One manages, therefore, sometimes by the mounting of a control gate and a pipe valve with the initially described features in the concrete conveying conduit. This valve has been positioned up till now behind the control gate and as a practical matter is formed of a flangeable housing, in which the prepared wiper is positioned. One can, with a closed gate, insert the housing and, after opening of the gate, press the wiper through the conduit. This process has the considerable advantage, that the remaining concrete can be conveyed in the concrete forms of the construction site and thus is not lost. It has, however, heretofore, the essential disadvantage that the insertion and removal of the described pipe valve requires too much time and too great a technical effort.

The present invention has as its object to provide a piping valve that can remain permanently in the conduit, the shifting of which is saved and which is itself cleaned by the wiper.

According to the invention this object is achieved through a reciprocally displaceable part, that has a transmission pipe alignable with the conduit and a pipe chamber accommodating the wiper formed as a blind pipe, the base of which has a connection canal to the external pressure means connection.

Through the reciprocal adjustability, it is possible, with the valve permanently inserted in the conduit to use the transmission pipe for the concrete conveying and to change to the wiper by means of the pipe chamber, at which time the conduit is shut off with the base of the blind pipe. In this operating condition the passage then needs only the pressure means—water pressure or air pressure—through the connection canal to become cleared. The wiper slides the remaining concrete ahead of itself out of the pipe conduit and thus wipes the pipe clean.

As soon as the conduit is empty, one can shift the part so that the transmission pipe filled with concrete is likewise emptied with the reverse suction of the wiper, and the connected conduit part up to the reservoir is drained by this. Thus one can insert the piping valve according to the invention in the conveying conduit in immediate adjacency to the reservoir so that the losses of the remaining portion play no role.

Preferably and according to a further feature of the invention, the reciprocally displaceable part is formed as a slide in which the transmission pipe and the blind pipe are arranged with their axes parallel. One can, in known ways, actuate such a slide by hand or also by means of a shifting motor.

Preferably, according to the invention, one provides the pressure means connection with a T-piece, on which a manometer and a vent or relief means may be connected.

It becomes possible, according to the invention, through the reciprocal adjustability of the part with permanent insertion of the valve in the conduit to use the transmission pipe for the concrete conduction and by means of the pipe chamber to transfer the wiper, at which time the conduit is shut off with the base of the blind pipe. In this operating condition the passage then needs only the pressure means—water pressure or air pressure—through the connection canal to become cleared. The wiper then slides the remaining concrete ahead of itself out of the conduit and thus wipes the pipe clean.

If at the end of the conveying, the cleaning should be effected, the slide must be operated, without the pressurized medium in the conductor reaching the outside. It is thus provided, that both ends of the transmission pipe are sealed in the slide housing on a plate, whereby the pipe ends slide on their associated plates with the displacement process. These seals require extensive housings and are problematical on the technical and economic grounds. As a result, the housing must be mounted as separated parts beyond a pump, for example a concrete pump in the conveying conduit. In this manner the conveying conduit is prevented from being connected simply on the pump.

As soon as the conduit is empty, one must shift the part of the valve, so that the transmission pipe filled with concrete likewise empties with the reverse suction of the wiper and the connected pipe piece is by this emptied into the reservoir of a pump. The valve cannot be installed immediately behind the concrete pump. The contents of the reservoir, on existing portable pumps, in particular concrete pumps, in which one must store the concrete discharged with the reverse suction of the wiper in the reservoir and later remove it therefrom is limited. This thus leads with the concrete conveying to considerable difficulties because the concrete cannot be placed in the construction form. This concrete must be stored on the construction site or otherwise.

According to the invention there also results a simplified housing and the possibility of reducing the residual concrete amount which must be stored in the reservoir.

For that purpose is provided in a first line, that the transmission pipe is formed as a bent swivel body, whose discharge end is connected with a joint in the conveying conduit and whose inlet end is sealed and movable on a plate, which, respectively, has an opening for the pipe chamber arranged behind it and for a pipe formed inlet of the conveying conduit.

There one can thus simplify the transmission pipe as a result of its permanent formation as a swivel body; if also linking connection with the conveying conduit is kept, one needs no plate seal on the conveying side end of the transmission pipe, and can thus correspondingly simplify the housing. Besides, with the transmission pipe serving for the connection of the pipe chamber with the conveying conduit, it is together with the conveying conduit cleaned in a working cycle. As a result, the remaining conveying amount that is removed with the reverse suction out of the conveying passage, is correspondingly reduced. Accordingly, the possibility arises, to install the piping valve immediately behind a pump, particularly a concrete pump, without the conduction conduit being interrupted as heretofore immediately before the pump. The small distance of the pump pistons from the valve makes possible the suction of the remaining thick material quantity in the reservoir, so that the entire conveying passage after the termination of the conveying is cleaned in a simple manner.

Preferably, according to the invention a further simplification of the entire structure of a viscous material pump, in particular a concrete pump in which the valve according to the invention may be mounted, is achieved in that the transmission pipe forms an element with a swivel body, that connects the pair of alternately filling and conveying conduction cylinders of a piston pump with the conveying conductor, whereby the plate for each conduction cylinder and the pipe chamber has openings that are arranged on a side of the reservoir of the pump.

In this instance, one uses, namely, the housing of the displaceable part of the piston pump as the housing of the valve, whereby one simply provides a pipe chamber in the existing housing and the already existing swivel body in such housing additionally serves as the transmission pipe, because it, as a result, inactivates the conduction of the pump during the cleaning.

Therefore, the transmission pipe of the valve according to the invention can exhibit the customary forms with the associated displacement parts of the piston pumps, in particular concrete pumps. It can, therefore be bent generally S-formed, or can also be realized with a simple pipe bend.

For a further understanding, the invention is explained more specifically in the following with the aid of a plurality of embodiments, that reflect the details of the invention, its further features and other advantages.

FIG. 1 schematically, i.e. with ommission of all details not necessary for the understanding of the invention, and in longitudinal section, shows a concrete conveying conduit mounting a piping valve according to the invention, parts of which are positioned in a first operating position.

Figure 2:
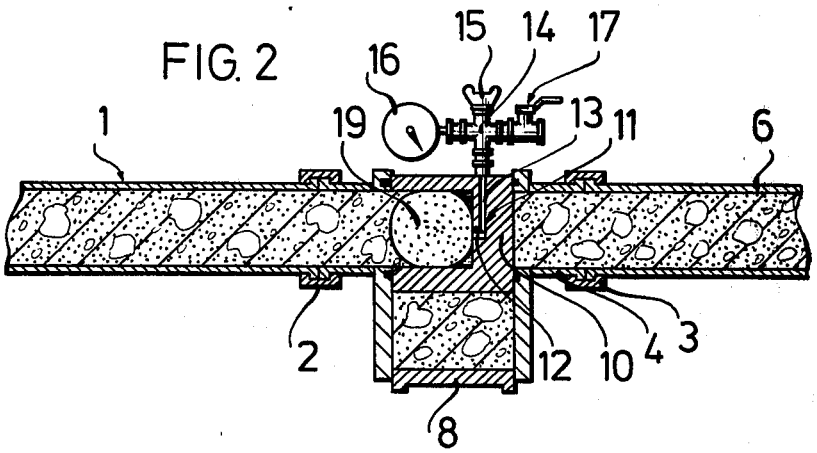
Figure 3:
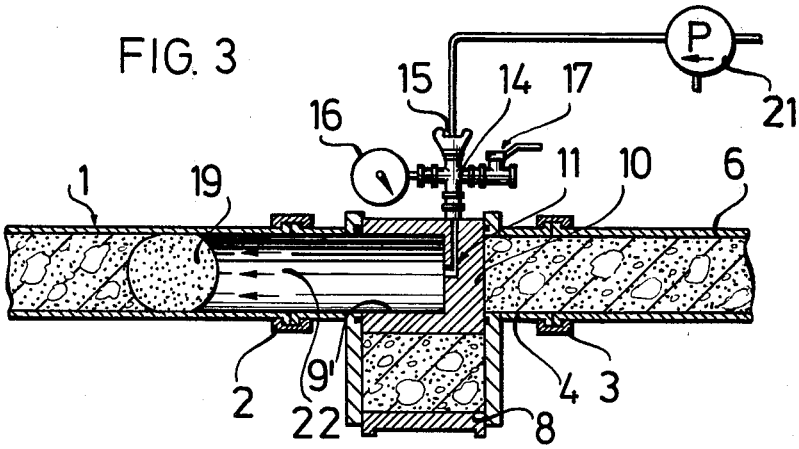
Figure 4:
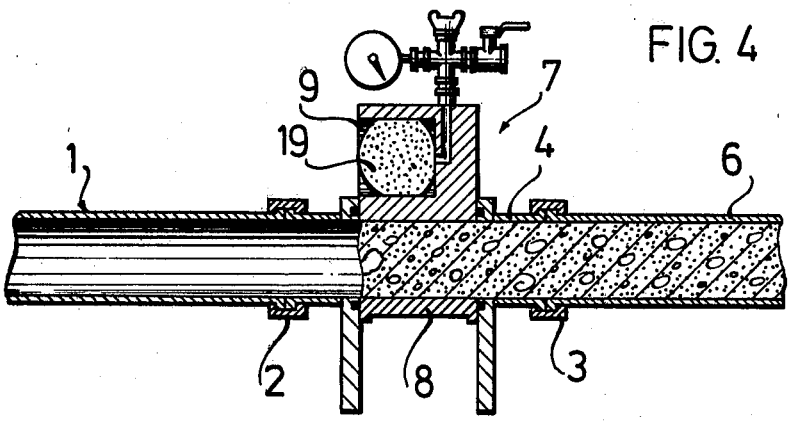
Figure 5:
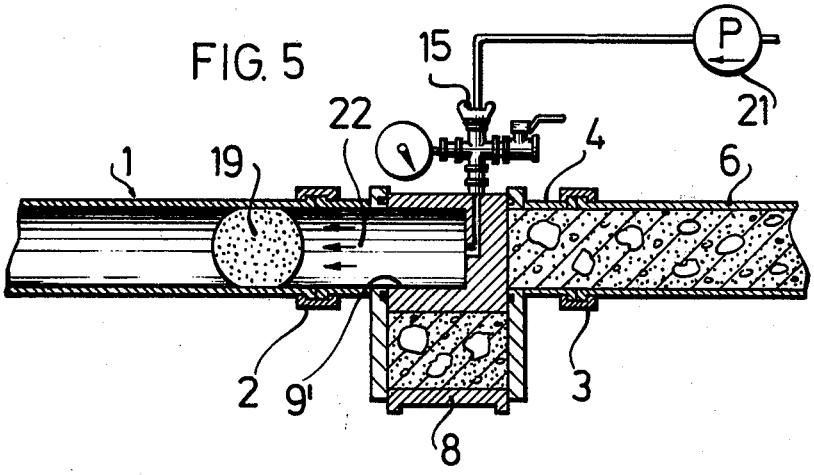

FIG. 2 shows a further operating position in a view corresponding to FIG. 1, FIG. 3 shows the cleaning of the conduit by means of the presure means, in a view corresponding to FIGS. 1 and 2, FIG. 4 shows the operating position according to FIG. 1 at the end of the cleaning, FIG. 5 shows the preliminary step for the cleaning of the reciprocally displaceable part and of the remaining parts of the conveying conduit.

Figure 6:
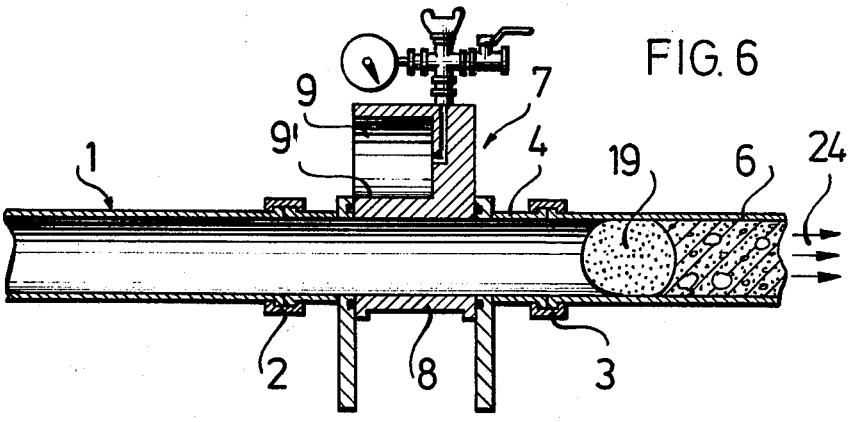
Figure 7:
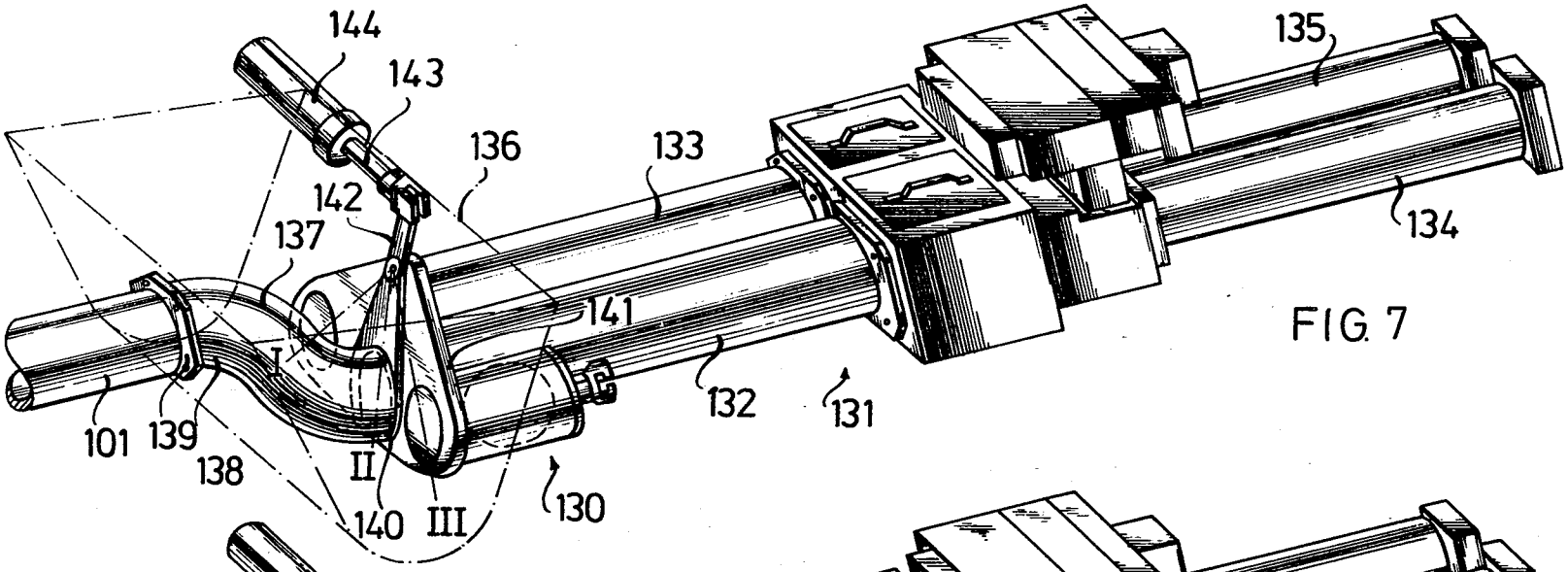
Figure 8:
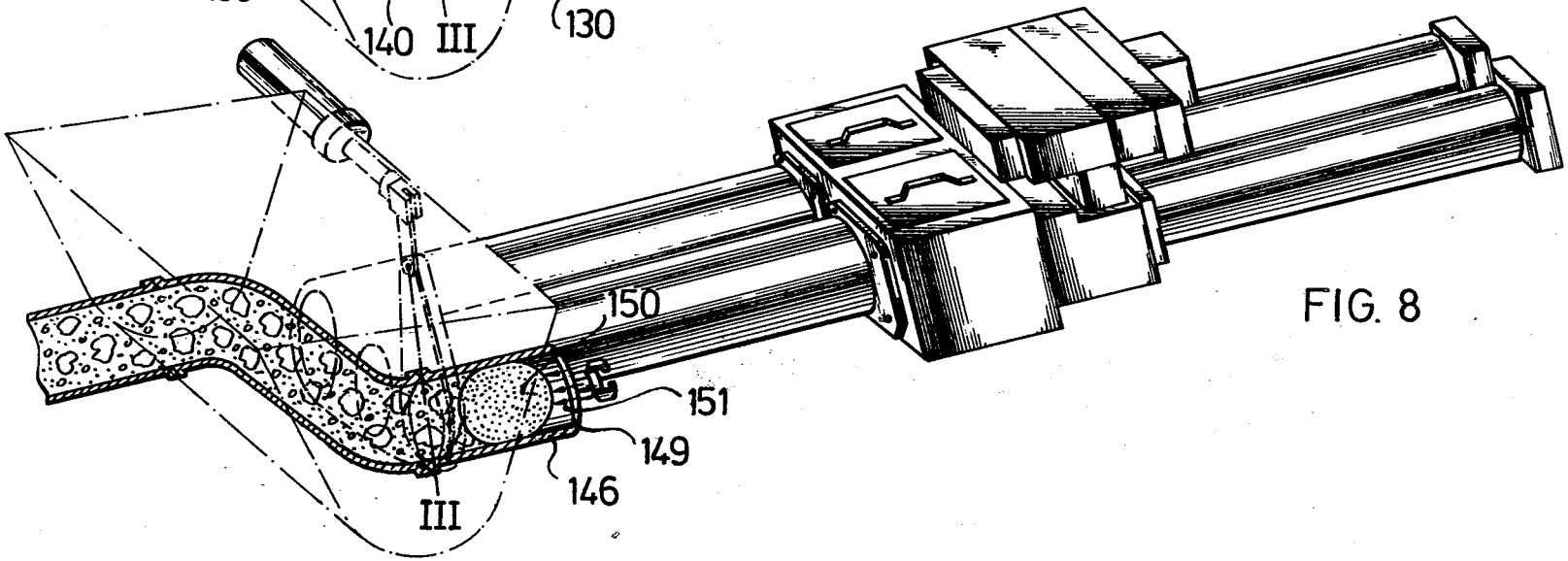
Figure 9:
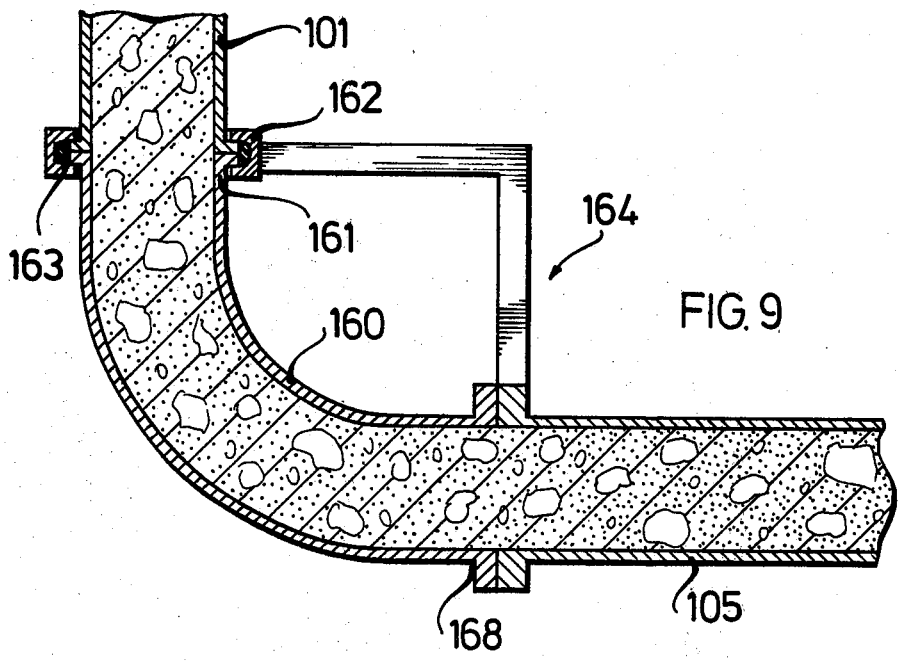
Figure 10:
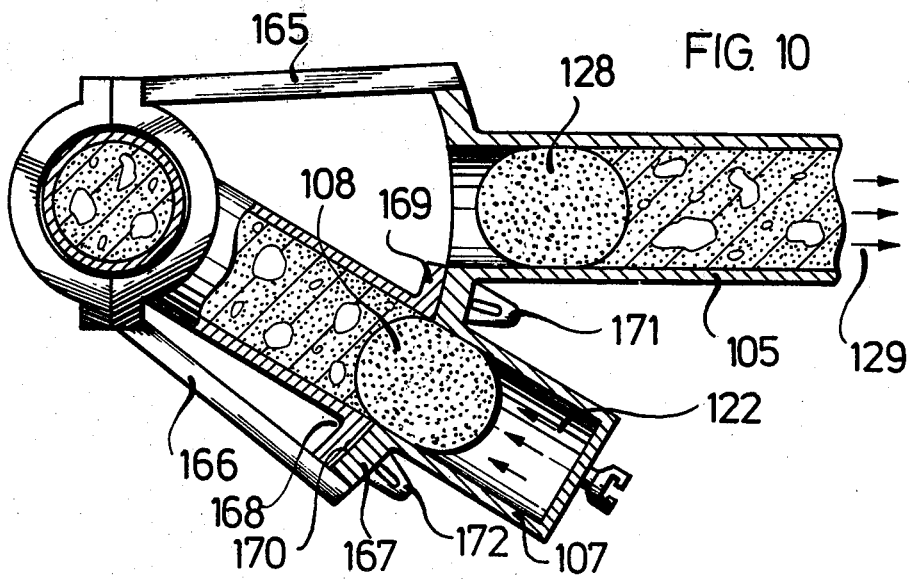
Figure 11:
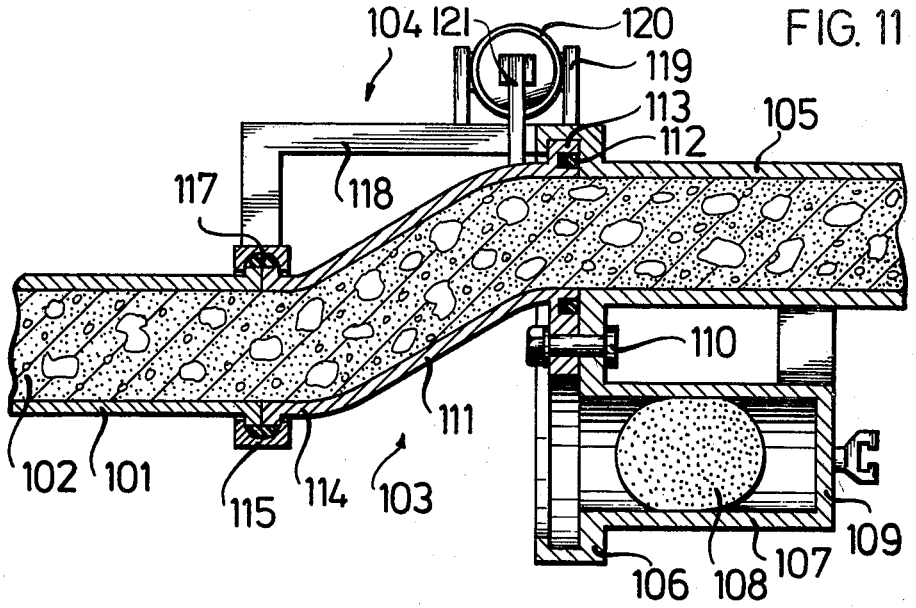
Figure 12:
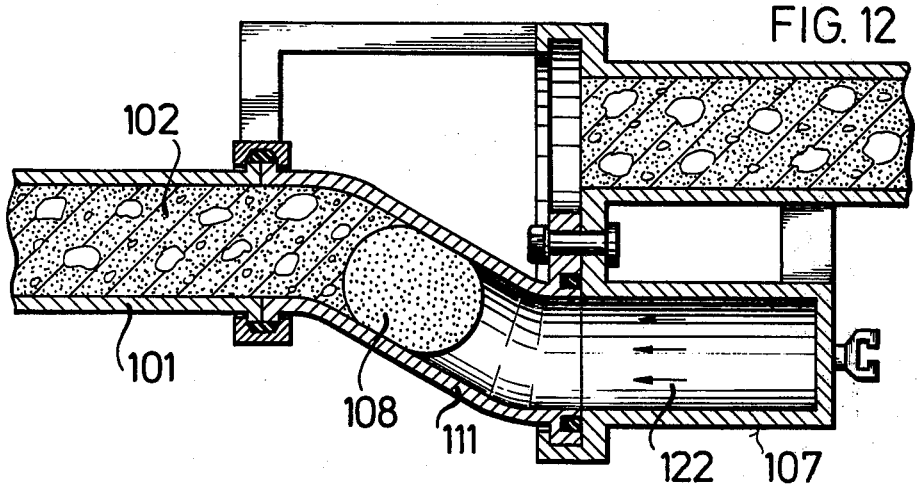
Figure 13:
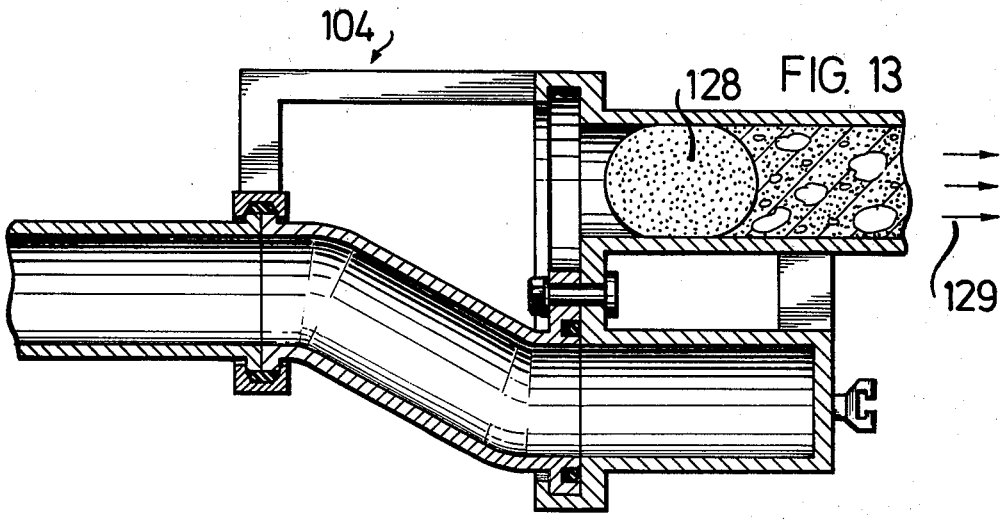

FIG. 6 shows the cleaning of the remaining part of the conveying conduit in a view corresponding to FIGS. 1 through 5, FIG. 7 shows a schematic perspective view of a concrete pump with an integral piping valve according to the invention, FIG. 8 shows, in a view corresponding to FIG. 7, the position of the parts with the cleaning of the conveying conduit, FIG. 9 shows in section, and with the removal of all details not necessary for the understanding of the invention, another embodiment of a piping valve according to the invention integrated in the parts of a concrete conveying pump, FIG. 10 shows a plan view of the element of FIG. 9, FIG. 11 shows, partly in section, another embodiment of the piping valve according to the invention, that can be installed in a discretionary position in a conveying conduit, FIG. 12 shows the element of FIG. 11 in the other operating position of the swivel body, and FIG. 13 shows, in a view corresponding to FIGS. 11 and 12, the cleaning of the conduit section mounted on the pipe valve and extending up to the not disclosed pump.

In the Figures, a concrete conveying conduit is indicated by 1, that preferably is supported from a not shown concrete distribution mast. A housing 4 that belongs to the piping valve indicated generally with 5 is flanged on with the elements 2 and 3. The housing 4 is, in this manner, installed in the conduit 1. The installation position is located immediately behind a not disclosed reservoir to which pipe 6 leads.

The conduit has a reciprocally displaceable part that is indicated generally with 7. According to the disclosed exemplary embodiment, the part is formed out of an element that combines a transmission pipe 8 and a pipe chamber 9. The pipe chamber, for its part, is formed, as FIG. 3 particularly shows, of a blind pipe 9', whose base 10 is provided with a connection channel (FIG. 2), that carries the reference number 11. The connection canal has a section 12 that is arranged axially to the blind pipe 9 and a section 13 bent with respect to this section 12, that runs normal to the axis of conveying conduit 1 and accordingly leads exteriorly. On the outer lying end of the connection canal 11 is located a T-piece 14, in which a connection for a pressure means, for example, water pressure or air pressure, is mounted, as well as a manometer 16 that indicates the pressure in the conductor produced by the pressure means. A tap 17 makes possible the venting of the conveying conduit 11 when in the open condition.

According to the disclosed exemplary embodiment, the above described element 7 is formed as a slide, that can be adjusted in a plane standing orthogonally to the conduit axis in two operating positions. In the position reproduced in FIG. 1, the blind pipe 9 lies outside the housing 4. Thus the wiper shown generally with 19 (see FIG. 2) in the form of a ball can enter the pipe chamber, which is formed from the blind pipe 9'. In the same position however the transmission pipe is aligned with the conveying conduit 1 and the connected pipe 6. As a result, concrete can be forced out of the reservoir by means of the not disclosed pump into the conduit 1 and can be conveyed.

As soon as the conveyance is ended, the entire conduit, including the reciprocally displaceable part, must be freed of the concrete, that would otherwise harden and block the conveying passage. For this purpose, the part is displaced in the other operating position that is reproduced in FIG. 2. In this position, the pipe chamber is aligned with the conveying conduit 1, however, the transmission pipe 8 filled with concrete located inside the housing 4, is not yet freed of the concrete.

Initially, the conveying conduit 1 is emptied and thereby wiped clean. For the purpose according to the exemplary embodiment, water pressure is applied through the connection canal 11 in the pipe chamber by means of a pump 21 through the connection 15. Thus, the wiper 19 is accordingly moved in the direction indicated through the arrows 22 and forces the remaining concrete ahead of it, that discharges at the end of conveying conduit 1 and can be disposed of in the concrete form, that has previously been filled with the conveyed concrete.

At the end of the emptying and cleaning process the wiper 19 is discharged out of the pipe.

After that one again displaces the part 7 in its starting position according to FIG. 1 that is reproduced in FIG. 4. With that, the transmission pipe 8, with the concrete contained in it, is again aligned with the conveying conduit 1 and the connected pipe 6; the pipe chamber 7, however again attains a position, in which the wiper can be inserted in the blind pipe.

Thereafter one renews water pressure with the pump 21 released through the connection 15 in the blind pipe 9 that is shown in FIG. 5, so that the wiper moves again in the direction of arrows 22. One needs however to force the wiper 19 only so far in the conduit 1, i.e. in the housing 4, that the movement of the displaceable part 7 is again cleared.

After this occurs, one again displaces the part 7 to its second position, that is shown in FIG. 6. In this position the not disclosed concrete pump can draw the wiper body 19 through the pipe 6, that slides the remaining concrete contained in the transfer pipe 8 and the conduit 6 ahead of itself and ultimately conveys it to the reservoir.

In a variation of the disclosed exemplary embodiment, one can use air pressure instead of water pressure. Then one must naturally meticulously observe the manometer 16, because air, in contrast to water pressure, is compressible and thus the remaining concrete can suddenly emerge out of the conveying conduit 1.

For a better understanding, the invention is initially more specifically explained with the aid of the constructional configuration according to FIGS. 11–13. A conveying conduit 101 for concrete 102 is separated at 103 to produce a not disclosed conduit section that leads to a concrete pump. At the terminating point, a piping valve is installed in a housing 104. The housing confines itself to the respective parts, that are necessary for the transfer of the separating forces and for the mounting of the pair of conduit parts of the concrete conveying conductor 101.

Accordingly, the housing has a pipe formed inlet 105 for the arriving concrete, with which the housing is, for example, flanged on the concrete pump. The inlet pipe 105 seats on a face plate 106 of the housing 104, on which moreover a pipe chamber 107 is fastened. The pipe chamber is during the concrete conveying reproduced in FIG. 11 empty with the exception of a wiper 108, that which the disclosed exemplary embodiment has the form of a ball. The pipe chamber 107 has the form of a blind pipe and possesses, therefore, a chamber base 109 that has a not disclosed connection canal to an exterior pressure means connection, whose function is further explained below.

Between the parts 105 and 107 is located a swivel axis 110 for a transmission pipe 111, that at its end turned toward plate 106 is so sealed on this plate by means of a seal schematically reproduced by 112, that in each operating position and in each intermediate position the flow of concrete 102 to the outside is prevented. The pipe end 114 lying opposite to the sealed pipe end 113 seats on a pipe joint 115 and is likewise, as schematically indicated by 117, sealed to the outside. The pipe joint 115 is connected by a tie rod 118 with the plate 106 of the housing. The tie rod serves additionally for the reinforcement of a preferably hydraulic positioning cylinder 120 supported by 119 that can so actuate the transmission pipe through a lever 121, that it pivots about the axis 110, whereby its seal 112 moves on the plate 106. By this movement, the transmission pipe 111 is rotated, as a result of its formation as an S-formed bent swivel body, in the pipe joint 115, so that it remains in permanent connection with the conveying conduit 101.

In operation, the concrete 102 moving by means of the not disclosed concrete pump is forced through the pipe formed inlet 105, the S-formed bent transmission pipe 111 and the conveying conduit 101. At the end of the conveying, the concrete located in the conveying conduit 101 and the parts of the valve mounted thereon must be removed in order to avoid the blocking of the conduction passages as a result of the hardening of the concrete. Through actuation of the thrust piston drive that is realized with the hydraulic cylinder 120, the transmission pipe 111 can, for this purpose, be brought in the position of FIG. 12, previous to which the described cleaning ball 108 has been inserted in the pipe chamber 107. One opens the not disclosed pressure means connection of the pipe chamber 107, so that a hydraulic or pneumatic cleaning medium, presses the wiper 108 initially through the transmission pipe 111 and then through the conveying conduit 101, as is indicated through the arrow 122 in FIG. 12. In this regard, the wiper slides the concrete 102 ahead of itself, which therefore is discharged at the free end of the conveying conduit, where it can be placed in a concrete form.

As a result of the open configuration of the housing 104, the same or an additional wiper 128 can moreover be introduced in the pipe formed inlet of the valve and through reversing the pump can be forced in the direction of the arrow 129 to the reservoir ordinarily provided with the associated pumps. With that, the entire conveying passage is then free of concrete.

With the embodiment according to FIGS. 7 and 8, the described valve is integrated in the reversing element 130 of a concrete pump indicated generally with 131. The concrete pump has two conveying cylinders 132, 133 each of which contain a piston, that is actuated from working cylinders 134, 135. The conveying cylinders 132 and 133 work alternately and to such a degree that their pistons draw in, with their return stroke, concrete out of a reservoir 136, which in the forward travel is pressed in the conveying conductor 101. The reversal necessary for that is provided with the reversing element that is mounted in the reservoir 136.

The reversing element 130 has a movable swivel body 137 in the form of a S-formed bent pipe. The end 138 of the swivel body seats in a pipe joint 139 while the oppositely lying end, that is the pipe end 140 on the cylinder side, slides on a plate 141 and is sealed on this. By means of a two-armed lever 142 the pipe end 140 can be swivelled through the piston rod 143 of a hydraulic cylinder 144 in three positions, that are indicated in FIG. 7 with I–III. The positions I and II serve for the concrete conveying.

In the position of the parts apparent from FIG. 7, the conveying cylinder 133 sucks concrete out of the reservoir 136 while simultaneously the conveying cylinder 132 presses the previously withdrawn concrete through the swivel body 137 in the conveying conduit 101. In the position I the conveying cylinders 132, 133 are inversely switched.

In the position III that is reproduced in FIG. 8, the thrust piston drive 143, 144 and the pipe end 140 align with the pipe chamber represented with 146, that has a removable pipe base 149. The removability of the pipe base makes it possible to introduce the cleaning body 150 in the pipe chamber 146 from the exterior, so that the reservoir 136 need not be brought to the emptied condition before the introduction of the wiper 150. As a result, the swivel body 137 and the mounted conveying conduit 101 can be cleaned in conjunction with the operation described with FIGS. 11–13 through the passage of the pressure means in the pipe chamber 146 according to the arrows 151.

The embodiment according to FIGS. 9 and 10 differs from the embodiment according to FIGS. 11–13 essentially through the form of the transmission pipe. The transmission pipe is, with the exemplary embodiment according to the FIGS. 9 and 10 indicated with 160, with its end 161 journalled in a pipe joint 162, that is sealed from the outside by 163, and with the end 161 connected with the conveying conductor 101. The housing is indicated by 164 and is again formed open. It comprises, in essence, the angle formed braces 165 and 166, as well as a bent plate 167, which carries the inlet 105 and the pipe chamber 107. Corresponding to the configuration of the plate 167, the other end 168 of the transmission pipe 160 is provided with a correspondingly bent flange 169, that is movable on the inner side 170 of the plate 167. The housing has moreover mountings 171, 172 for the fastening on the substructure of a transportable concrete pump.

FIG. 9 shows the position of the parts with the concrete conveying, with which the transmission pipe 160 is connected with the pipe inlet 105. FIG. 10 shows the parts in the position necessary for the cleaning. In this connection the transmission pipe 160 is aligned with the pipe chamber 107, whereby the pressure means is applied so that the wiper 108 can press the concrete ahead of itself corresponding to the arrows 122; while the wiper 128 is reverse suctioned corresponding to the arrows 129 in the reservoir.

We claim:

1. A piping element inserting a wiper in a pressurized viscous material conveying conduit means for cleansing movement through the conduit means responsive to forces exerted by a pressure source, said piping element being interposed in said conduit means and including: a transmission pipe (8) coupled to the conduit means (1) and reciprocally movable between a first position in which said pipe is aligned with the conduit means for permitting the conveyance of viscous material through the conduit means and a second position in which said transmission pipe is out of alignment with the conduit means; and a chamber (9) accommodating the wiper, said chamber being coupled to said transmission pipe and alignable with the conduit means by the reciprocal movement of said transmission pipe, said chamber having connection means (11, 15) couplable to the pressure source for exerting forces on the wiper moving the wiper into and through the conduit means.

2. A piping element according to claim 1 wherein said transmission pipe (8) and chamber (9) are integrally formed in a slide element coupled to said conduit means for reciprocal movement transverse to the axis of the conduit means.

3. A piping element inserting a wiper in a pressurized viscous material conveying conduit means for cleansing movement through the conduit means responsive to forces exerted by a pressure source, said piping element being interposed in said conduit means and including: a transmission pipe (111, 137, 160) coupled to the conduit means (101, 105) and reciprocally movable between a first position in which said pipe is aligned with the conduit means for permitting the conveyance of viscous material through the conduit means and a second position in which said transmission pipe is out of alignment with the conduit means; and a chamber (107, 146) accommodating the wiper, said chamber being coupled to said conduit means and alignable with said transmission pipe by the reciprocal movement of said transmission pipe, said chamber having connection means (11, 15) couplable to the pressure source for exerting forces on the wiper moving the wiper into and through the conduit means.

4. A piping element according to claim 1 or 3 wherein said pressure source connection means (15) of said chamber (9, 107, 106) includes a manometer (16) and a pressure relief element (17).

5. A piping element according to claim 3 wherein said transmission pipe (111, 137, 160) is formed as a bent swivel body having an inlet end and a discharge end, said discharge end (114, 138, 161) is mounted in a swivel joint (115, 139, 162) in said conduit means (101), said wiper accommodating chamber (107, 146) is coupled to said conduit means (105), and said inlet end of said transmission pipe is movable between a first position in which said transmission pipe is aligned with said conduit means and a second position in which it is aligned with said chamber.

6. A piping element according to claim 5 including a plate (106, 141, 167) in which said conduit means (105, 132, 133) and chamber (107, 146) open, said inlet end moving on said plate between said first and second positions.

7. A piping element according to claim 6 wherein said conduit means has a pair of alternately filling and discharging conveying cylinders for a piston pump opening on said plate, and wherein said bent swivel body transmission pipe is further defined as alignable with said pair of cylinders of the conduit means.

8. A piping element according to claim 6 or 7 wherein the conduit means has a viscous material containing reservoir and wherein said plate is located in said reservoir.

9. A piping element according to claim 8 wherein said chamber has a removable cover for inserting said wiper.

10. A piping element according to claim 5 wherein said conduit means has a pair of alternately filling and discharging conveying cylinders for a piston pump and wherein said bent swivel body transmission pipe is further defined as alignable with said pair of cylinders of the conduit means.

11. A piping element according to claim 5 wherein said wiper is positioned for insertion in the conduit means (105) coupled to said chamber by the reciprocal movement of said transmission pipe.

* * * * *